United States Patent [19]

Guise et al.

[11] 4,101,272

[45] Jul. 18, 1978

[54] PROCESS FOR THE TREATMENT OF WOOL WITH POLYORGANOSILOXANES

[75] Inventors: Geoffrey Bruce Guise; Francis William Jones, both of Highton, Australia

[73] Assignee: Commonwealth Scientific and Industrial Research Organization, Campbell, Australia

[21] Appl. No.: 729,715

[22] Filed: Oct. 5, 1976

[30] Foreign Application Priority Data

Oct. 13, 1975 [AU] Australia ..... 3561/75

[51] Int. Cl.[2] ..... D06M 3/10; D06M 3/02; D06M 15/66; D06M 15/52

[52] U.S. Cl. ..... 8/127.6; 8/128 A; 427/386; 427/387; 8/DIG. 1; 528/10

[58] Field of Search ..... 8/127.6, 128 A, DIG. 1; 427/386, 387

[56] References Cited

U.S. PATENT DOCUMENTS

| | | | |
|---|---|---|---|
| 2,880,194 | 3/1959 | Glaser | 427/386 |
| 3,055,774 | 9/1962 | Gilkey et al. | 427/386 |
| 3,236,895 | 2/1966 | Tec et al. | 260/47 EP |
| 3,431,143 | 3/1969 | Johnson et al. | 260/46.5 R |
| 3,511,699 | 5/1970 | Johnson et al. | 428/264 |
| 3,741,932 | 6/1973 | Smith | 8/DIG. 1 |
| 3,761,444 | 9/1973 | Mendicino | 260/46.5 R |
| 3,980,599 | 9/1976 | Kondo et al. | 260/46.5 R |
| 4,022,946 | 5/1977 | Cummings | 427/386 |
| 4,046,930 | 9/1977 | Johnson et al. | 427/387 |
| 4,054,716 | 10/1977 | Topfl | 427/386 |

FOREIGN PATENT DOCUMENTS

| | | | |
|---|---|---|---|
| 1,515,016 | 9/1966 | France | 8/DIG. 1 |
| 1,296,136 | 11/1972 | United Kingdom. | |

*Primary Examiner*—Joseph L. Schofer
*Assistant Examiner*—Maria S. Tungol
*Attorney, Agent, or Firm*—Dennis P. Clarke

[57] ABSTRACT

A process for the treatment of fibrous materials to improve their properties, in which the fibrous materials are treated with a composition containing:

a component A selected from the class consisting of polyorganosiloxanes of the general formula $$R_nSiO_{\left(\frac{4-n}{2}\right)}$$

in which $n$ has an average value in the range 1.8 to 2.2, and R represents organic radicals attached to the silicon atoms by carbon-silicon bonds; wherein between 1.0 and 50% of the radicals R consist of one or more organic radicals containing an epoxide group and selected from the class consisting of: 1,2-epoxyethyl; 3,4-epoxycyclohexyl; 6-methyl-3,4-epoxycyclohexyl; 3,4-epoxycyclohexyl-1-ethyl; 9,10-epoxystearyl; 3-(2,3-epoxypropoxy)propyl; p-(2,3-epoxybutyl)-phenyl; and 3-(3,4-epoxybutyl)cyclohexyl, and the remainder of the radicals R consist of one or more organic radicals selected from the class consisting of alkyl and aryl radicals;

and a polyamine component B which consists of one or more organic compounds each with two or more primary and/or secondary amino groups attached to aliphatic carbon atoms such that there is at least 5 carbon atoms per amino group, or two or more groups capable of providing, by reaction, primary and/or secondary amino groups;

and allowing the components A and B to react chemically.

11 Claims, No Drawings

PROCESS FOR THE TREATMENT OF WOOL WITH POLYORGANOSILOXANES

This invention relates to methods for treating fibrous materials, particularly those containing wool, with compositions containing polyorganosiloxanes with epoxy substituents. The general object of these treatments is to improve various textile properties, including resistance to felting shrinkage.

The treatment of fibrous materials with polysiloxanes is well known, but to impart durability to repeated washing and drycleaning it is usually necessary to crosslink the polyorganosiloxane. Many methods of crosslinking have been proposed including the use of polyorganosiloxanes with epoxy substituents and various crosslinking agents (for example, British Pat. No. 1,296,136 and U.S. Pat. Nos. 3,431,143 and 3,511,699).

We found little improvement to the properties (e.g. felting shrinkage) of wool treated with mixtures of polyorganosiloxanes with epoxy substituents and conventional polyamine epoxy resin curing agents. But we have now unexpectedly found that the textile properties of materials containing wool can be usefully improved by the use of a composition containing a particular type of polyorganosiloxane with epoxy substituents (hereafter termed component A) and a particular type of polyamine (hereafter termed component B). Furthermore, certain components A or B provide greater improvements than others.

According to one aspect of the present invention, there is provided a process for the treatment of fibrous materials which comprises the steps of treating the fibrous materials with a composition containing components of classes A and B as defined below and allowing the components of this composition to react chemically.

Component A, for use in the present invention contains one or more polyorganosiloxane of the general formula $$R_nSiO_{\left(\frac{4-n}{2}\right)}$$

in which n has an average value in the range 1.8 to 2.2, and R represents organic radicals attached to the silicon atoms by carbon-silicon bonds. Between 1.0 and 50% of the radicals R consist of one or more of the following organic radicals containing an epoxide group; 1,2-epoxyethyl; 3,4-epoxycyclohexyl; 6-methyl-3,4-epoxycyclohexyl; 3,4-epoxycyclohexyl-1-ethyl; 9,10-epoxystearyl; 3-(2,3-epoxypropoxy)propyl; p-(2,3-epoxybutyl)-phenyl; and 3-(2,3-epoxybutyl)cyclohexyl. The remainder of the radicals R are one or more alkyl or aryl radicals for example methyl, ethyl, propyl or phenyl.

In the component A the polyorganosiloxane chains may be linear or branched and may be terminated by organic radicals or by hydroxyl, alkyloxy, acyloxy and/or hydrogen radicals.

Methods for the preparation of epoxy-containing polyorganosiloxanes suitable for class A are well known, for example the epoxidation of olefinic substituents in the polyorganosiloxane with reagents such as peracetic acid. A better method is the addition of compounds with a silicon hydrogen bond across the olefinic bond of an unsaturated epoxide. A number of examples of such reaction have been described using various catalysts, for example British Pat. Nos. 834,326 and 1,213,779 and U.S. Pat. No. 3,761,444. It is to be appreciated that the products from such reactions may contain residual Si-H groups. It is also to be appreciated that the products containing epoxide from such reactions may be subsequently equilibrated with polyorganosiloxanes not containing epoxy substituents and thereby products with different viscosities, molecular weight distributions, or substitution patterns obtained. Such equilibrations have been described in U.S. Pat. No. 3,761,444. The most preferred components A are linear polydimethylsiloxanes with viscosity at 25° C in the range 100–50,000 cst. in which 5–50% of the methyl groups are replaced by the following radicals

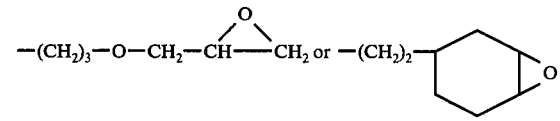

It was found that if component A, and in particular the preferred types, were applied to wool with conventional curing agents such as ethylene diamine, diethylene triamine, N-aminoethylpiperazine, methylene-bis-aniline (and those listed below in example 1) little improvement in the properties of the fibrous material was obtained after heating, for example, there was no reduction in the extent of felting shrinkage when the treated fabrics were washed. However, the desired improvements were obtained with a particular type of polyamine (component B) which contains one or more organic compounds each with two or more primary and/or secondary amino groups attached to aliphatic carbon atoms such that there is at least 5 carbon atoms per amino group, or two or more groups capable of providing, by reaction, primary and/or secondary amino groups. The preferred component B has the structure $$R'NH - A - NHR''$$

where A is a divalent organic radical and R′ and R″ may be either hydrogen or an organic radical, in which R′, A and R″ combined contain in total at least 10 carbon atoms. The radicals R′ and R″ may, in addition, contain further primary and/or secondary amino groups.

Examples of suitable components B include:

(a) Diamines of the type $NH_2(CH_2)_nNH_2$ where $n$ is 10 or greater.

(b) Amines of the type $YNH(CH_2)_nNH_2$, where $n$ is 2 or greater, and Y is an alkyl radical containing more than 10 carbons.

(c) Linear or branched polymers of ethylene and/or propylene oxides with terminal 2-aminoethyl or 2-aminopropyl ether groups. For example those discussed in U.S. Pat. Nos. 3,236,895 and 3,462,393.

(d) Di- and higher amines prepared by the reduction of the nitriles of the polymers of unsaturated fatty acids, for example the commercial products known as "dimer acids" which are prepared by dimerizing thermally or with catalysts natural $C_{16}$ to $C_{20}$ fatty acids with one or more units of unsaturation, for example linoleic, linoleic and oleic acids. Such unsaturated acids are obtained by the hydrolysis of natural oils which occur as triglycerides. Such "dimer acid" will contain a variety of species as well as monomeric and higher polymers, and will usually have some unsaturation. A typical dimer structure is a tetrasubstituted cyclohexane with 2n-alkyl or alkenyl substituents and 2 substituents comprising an n-alkyl or alkenyl chains with terminal carboxyl groups. The polyamines will therefore have a similar structure in which the carboxyl groups are converted to $—CH_2NH_2$ groups. The preparation of polyamines of this type is discussed in British Pat. No. 1,023,390.

(e) Products from the reaction of (d) with acrylonitrile which have been subsequently hydrogenated.

Commercial examples of classes (b)-(e) are given in the examples below.

The component B may be present as such or in a latent form which can be converted into component B by some chemical reaction before, during, or after the application to the fibrous materials. Examples of compounds which hydrolyse to components B include ketimines prepared from amines and ketones and the related aldimines and enamines.

The component B in compositions of the present invention may be wholly or partially replaced by a amine of the types $R'''NH_2$ or $(R''')_nNH$ where R''' is an alkyl or alkenyl group containing twelve or more carbon atoms, for example stearyl amine. It is to be appreciated that such primary amines are capable of reaction with two epoxides and thus crosslink.

To the compositions, organic compounds containing one or more epoxides may also be added. Such epoxides preferably do not contain hydroxyl groups or aromatic rings.

The present invention involves treatment of the fibrous material in the form of loose fibre, yarn or fabric with from 0.1 to 50% by weight, preferably from 1 to 10%, of the composition of A and B as defined before, in which the ratio of A and B components by weight is in the range 1:100 to 100:1, by one of the following methods:

(a) By treatment with a solution of the composition in an organic solvent. Suitable organic solvents include perchloroethylene, trichloroethylene, white spirit, benzene or other hydrocarbons or halogenated hydrocarbons and the like.

(b) By treatment with an emulsion or dispersion of the composition or with an emulsion or dispersion of a solution in a water-miscible solvent in water. Such emulsions or dispersions preferably contain surface active agents. Such emulsions or dispersions may be prepared by emulsifying or dispersing a mixture of A and B, or by separately emulsifying A and B and mixing the two emulsions.

(c) By treatment with an emulsion of component A in which the aqueous phase contains dissolved component B as the free polyamine or in the form of a salt with an organic or inorganic acid.

Subsequently, the material is dried to remove water and solvent if present. The chemical reaction between components A and B, may occur during the treatment, subsequently, or in a subsequent heating operation.

The application to the fibrous material may be by padding, spraying, brushing, dipping or the like, or by (in the case of aqueous emulsions) as in (b) and (c) above by an exhaustion technique from a long liquor ratio. In such exhaustion treatments it is preferable to add a polycationic material to facilitate exhaustion.

The fibrous material is preferably wool, but this may be wholly or partially replaced by one or more of the following fibres: mohair, cotton, regenerated cellulose, cellulose acetate, polyesters, polyamides, polyolefins, polyvinylhalides and the like.

During such application to fibrous materials of compositions of the present invention, various agents may be added to modify other textile properties, to modify various properties of the polymeric coating, to modify the properties of the solutions or emulsions used for application, or to control the pH.

The compositions of the present invention may also contain one or more other polymeric materials, for example, latices of polyacrylic and methacrylic acid esters.

The processes of the present invention have been found to impart to wool or wool-blend fabric a high level of resistance to felting shrinkage, improve the wrinkle recovery of the fabrics, improve the resistance to abrasion and pilling, stabilize creases particularly to release in steam, impart smooth drying properties, improve the tailorability and reduce needle damage during sewing and the like. Such improvements enable permanent of durable-press garmets to be produced (i.e., garments which after a machine or severe washing and drying retain their original dimensions and creases or pleats and the smooth areas return to a flat wrinkle-free state) and this can be done via several routes. For example, the fabric is made shrink-resistant using the process of the present invention and subsequently the garments are permanently set such as a British Pat. Nos. 1,259,595 and 1,278,934. Another method, such as in Australian Pat. No. 452,926, the garment is treated with a composition of A and B, pressed (or these operations are reversed), the chemical reaction between the components is allowed to take place, then the garments are subjected to a prolonged steaming. A novel modification of this sequence is a delayed cure treatment, i.e., a period of time is allowed to elapse between treatment and curing which enables treatment of fabrics rather than garments.

The processes of the present invention have been found to have, in many cases, advantages over prior art polymer treatments for wool and this is illustrated in the examples below. For example, the cured polymer on wool has been found to be particularly stable to photo and thermal degradation in contrast to polymers with polyether backbones which are prone to such degradation and this causes loss of shrink-resistance.

The use of the processes of the present invention with fibrous materials not containing wool may also produce desirable improvements.

It is to be appreciated that many other modifications can be made to the methods described above, and that all such modifications are considered to be within the scope of this invention. The following examples are provided to illustrate the present invention but are not to be construed as limiting the invention in any way.

EXAMPLES

In the following examples the application levels are expressed as the % by weight of the composition applied per weight of fabric.

Fabrics

A. A plain weave wool worsted fabric (150 g/m$^2$)
B. A wool worsted shirting (150 g/m$^2$)
C. A grey wool serge (200 g/m$^2$)

Area Shrinkage

A 1 kg load consisting of treated samples of fabric A (approximately 100 g) and polyester weighting squares was washed in a 50 l Cubex International machine with 12.5 l wash liquor, 40° C, pH 7.5, containing 0.05 g/l sodium dodecyl benzene sulphonate, 0.1 g/l sodium dihydrogen phosphate and 0.29 g/l disodium hydrogen phosphate. The area shrinkages quoted are for samples which were relaxed for 20 minutes in the above wash solution at 40° C prior to washing. Untreated samples shrank about 70% after a 1 hour wash. Area shrinkage in excess of 8% was considered to be a failure.

Commercial Polyamines

Class (b)

Diam 11. N-oleyl-1,3-propylene diamine.

Diam 21. N-Coco-1,3-propylene diamine.

Class (c)

Jeffamines D-400 and D-2000. A bis(2-aminopropyl) ether of a polypropylene oxide diol molecular weights 400 and 2000 respectively.

Jeffamines ED-600 and ED-900. A bis(2-aminopropyl) ether of ethylene oxide — propyleneoxide copolymer diols molecular weights 600 and 900 respectively.

Jeffamine T-403. A Tris (3-aminopropyl) ether of a polypropylene oxide triol molecular weight 400.

Class (d)

Dimer Diamine. A $C_{36}$ diamine prepared from dimerised fatty acids.

DP 3680. A diamine prepared from dimerised fatty acids.

Class (e)

Dimer Tetramine. A $C_{42}$ tetramine prepared from reaction of dimer diamine with acrylonitrile followed by hyrogenation.

SYNTHESIS OF POLYORGANOSILOXANES WITH EPOXY SUBSTITUENTS

Suitable component A expoxysilocones of the present invention were prepared by the known sequence of reaction of polydimethylsiloxanes containing silicon hydride groups with olefinically unsaturated epoxides in the presence of a catalytic amount of hexachloroplatinic acid. A typical example follows.

To a 500 ml flask equipped with a stirrer, reflux condensor and nitrogen inlet was added 100 g of a polydimethylsiloxane containing 14 mole percent of Si-H groups and a viscosity of 550 cps at 25° C, 100 ml of dry toluene, 50 g of allyl glycidyl ether and 0.04 ml of a 3% solution of hexachloroplatinic acid in t-butanol. The mixture was stirred and heated at 100° C for 2 hours under nitrogen, then cooled to 25° C, filtered, and the solvent and excess olefin removed at 70° C and a pressure of 2 mm/Hg. The product, polymer I had a viscosity of 680 cps at 25° C and contained 14 mole % of epoxide groups.

In a similar manner further polymers were prepared with different molecular weights, epoxide contents, and epoxide types and the details of the starting materials and products are summarised in Table I.

TABLE I

| | Reactants | | | Product | |
|---|---|---|---|---|---|
| Polymer No. | Silicone Viscosity (cps) | Si-H content (mole %) | Unsaturated Epoxide | Viscosity (cps) | Epoxy Content (mole %) |
| I | 550 | 14 | A | 680 | 14 |
| II | 400 | 5.4 | A | 420 | 5 |
| III | 500 | 9.7 | A | 10 | 9.5 |
| IV | 1150 | 4 | A | 1850 | 3.8 |
| V | 400 | 5.4 | B | 900 | 4.8 |
| VI | 70 | 11 | A | 100 | 10.6 |

TABLE I-continued

| | Reactants | | | Product | |
|---|---|---|---|---|---|
| Polymer No. | Silicone Viscosity (cps) | Si-H content (mole %) | Unsaturated Epoxide | Viscosity (cps) | Epoxy Content (mole %) |
| VII | 1500 | 14 | A | 2200 | 13.6 |

A = allyl glycidyl ether

B = vinyl cyclohexene monoside (3-vinyl-7-oxabicyclo [4.1.0] heptane.

EXAMPLE 1

In this example polymer I and various polyamines were applied to wool. Certain polyamines which are used as curing agents for conventional epoxy resins were found to be unsuitable.

Samples of fabric A were treated with a mixture of 3% Polymer I and 1% of the polyamine from perchloroethylene solution. After the solvent had evaporated the samples were heated for 1 hour in an oven at 120° C, and then washed for various times in the above wash test. The polyamines showed the following behaviour.

A: Samples failed a 1 hour wash test and showed similar area shrinkage after 1 hour to untreated samples.

| | |
|---|---|
| ethylene diamine | methane diamine |
| diethylene triamine | isophorone diamine |
| triethylene tetramine | |
| 1,3-diaminopropane | |
| 1,6-diaminohexane | |
| N-β-aminoethyl-γ-aminopropyltrimethoxysilane | |
| N-aminoethylpiperazine | |
| p-phenylene diamine | |
| methylene-bis-aniline | |
| methylene-bis-o-chloroaniline | |
| m-xylylenediamine | |
| bis(p-aminophenyl) ether | |
| bis(p-aminophenyl) sulphone | |
| benzidine | |
| 1,4-bis(aminomethyl)cyclohexane | |
| 4,4'-methylene-bis-(cyclohexylamine) | |
| piperazine | |

B: The following polyamines passed a 2-hour wash-test but failed a 6-hour wash test.

1,12-diaminododecane

N-stearylamine 2-octadecylimidazole

Jeffamines ED-600, ED-900, D-400, T-403, D-2000

C: The following amines passed a 6-hour wash test.

Dimer Diamine, DP 3680, Diam 11, Diam 21, Dimer Tetramine.

EXAMPLE 2

This example demonstrated that provided a suitable polyamine component B is used, epoxysilicones with a range of epoxide contents and molecular weights can be used to impart a high level of resistance to felting shrinkage in wool fabrics. In all cases the treated fabrics were very resistant to loss of shrink-resistance by thermal or photodegradation on the cured polymer. This example also demonstrates that by use of component A with various molecular weights and epoxide contents it is possible to obtain wide variation in rate of curing. This may have practical advantages as in some situations rapid curing may be desirable whereas in others slow curing may be preferable.

Samples of fabric A were treated from perchloroethylene with 3% polymer and 1% Dimer Diamine and cured by heating. To determine the resistance to thermal and photodegradation, cured samples were heated for various times in an oven or exposed to daylight under glass for various periods, and then washed as before. The light fastness of >8 quoted below means that when an ISO Blue Standard % adjacent to the exposed sample had faded, the sample if washed would still pass the above 6-hour wash test. The thermal stabilities are the times which samples can be heated for and will still pass the above 6-hour wash test.

In the case of Polymers I and III, similar results were obtained when the fabric samples were treated by padding with an aqueous emulsion of the composition. Such emulsions were prepared by emulsifying a solution of the composition in toluene with the aid of a non-ionic surfactant mixture.

In the case of Polymer I, similar results were obtained if Dimer Diamine was replaced by DP 3680 or Dimer Tetramine.

TABLE II

| Polymer | Min. Curing Time (hours) to pass 6-hour wash test | | | Area Shrinkage (fully cured samples) 6-hr wash test | Light Fastness | Thermal Stability |
|---|---|---|---|---|---|---|
| | 100° C | 120° C | 130° C | | | |
| I | 1 | 0.5 | 0.25 | <2% | >8 | >20 hr 160 |
| II | 16 | 3 | 1 | " | " | " |
| III | 3 | 1.0 | 0.5 | " | " | " |
| IV | 16 | 2 | 1 | " | " | " |
| V | | >8 | 2 | " | " | " |
| VI | 3 | 1 | 0.5 | " | " | " |
| VII | 2 | 1 | 0.5 | " | " | " |

EXAMPLE 3

This example demonstrates that the compositions of the present invention are effective at low application levels for shrink-resisting wool fabrics.

Samples of fabric A were treated from perchloroethylene solution with mixtures of the various polymers and Dimer Diamine in the proportions 3:1 and 5:1 and heated sufficiently to effect curing. The following table shows the minimum application level of the composition to pass wash tests for 1, 3 and 6 hours.

TABLE III

| Polymer No. | Polymer : Dimer Diamine Proportion | Minimum Application Level to pass wash test for | | |
|---|---|---|---|---|
| | | 1 hr | 3 hr | 6 hr |
| I | 3 : 1 | 1.0 | 1.5 | 1.5 |
| I | 6 : 1 | 1.5 | 2.5 | 2.5 |
| II | 3 : 1 | 1.5 | 2.0 | 3.0 |
| III | 3 : 1 | 1.5 | 2.5 | 2.5 |
| III | 6 : 1 | 2.0 | 2.5 | 2.5 |
| IV | 3 : 1 | 1.5 | 2.0 | 3.0 |
| IV | 6 : 1 | 2.0 | 2.5 | 3.0 |
| V | 3 : 1 | 2.5 | 3.5 | 3.5 |
| V | 6 : 1 | 3.0 | 3.5 | 3.5 |
| VI | 3 : 1 | 1.0 | 2.0 | 2.0 |
| VI | 6 : 1 | 2.5 | 3.0 | 3.5 |
| VII | 3 : 1 | 1.0 | 1.5 | 1.5 |
| VII | 6 : 1 | 1.5 | 2.0 | 2.5 |

Similar results were obtained with Polymers I and III when the fabric was treated with an aqueous emulsion of the composition as in Example 2.

EXAMPLE 4

This example demonstrates that by use of various proportions of component A and B, it is possible to vary the handle of the treated fabrics.

Samples of fabric B were treated with compositions below from perchloroethylene solution and cured by heating. The bending length was measured according to BS 3356: 1961.

| Treatment | | | | | Bending Length |
|---|---|---|---|---|---|
| Untreated | | | | | 1.7 |
| 9% | Polymer | I 1% | Dimer | Diamine | 2.8 |
| 8% | " | I 2% | " | " | 3.3 |
| 7% | " | I 3% | " | " | 3.4 |
| 6% | " | I 4% | " | " | 3.3 |
| 9% | " | III 1% | " | " | 2.4 |
| 8% | " | III 2% | " | " | 2.4 |
| 7% | " | III 3% | " | " | 2.2 |
| 6% | " | III 4% | " | " | 2.0 |

EXAMPLE 5

This example demonstrates the use of compositions of the present invention as durable press sequences. In addition, the use of a delayed-cure treatment is demonstrated. This would allow in practice treatment to be effected at the fabric stage, and then at a later stage when the fabric had been converted into garments, curing could be effected.

Samples of fabric A were treated with the compositions given below from perchloroethylene solution. After the solvent had evaporated samples were then subject to the finishing sequence given. Samples were creased in a press with a 5 sec. steam, 10 sec. bake and 10 sec. vacuum cycle. The crease angle was measured on yarn snippets taken perpendicular to the crease after the samples had been washed for 1 hour in above wash test and drip-dryed.

| | Treatment | Finishing Sequence | Crease Angle |
|---|---|---|---|
| 1. | 3% Polymer I + 1% Dimer Diamine | (a) crease<br>(b) heat 30 mins 95°<br>(c) steam 90 minutes | 54 |
| 2. | 1.5% Polymer I + 0.5 Dimer Diamine | as 1 | 58 |
| 3. | 3% Polymer II + 1.0% Dimer Diamine | (a) crease<br>(b) heat 1 hour 30° C<br>(c) steam 90 minutes | 52 |
| 4. | 3% Polymer II + 1.0% Dimer Diamine | (a) heat 2 minutes 130°<br>(b) leave 2 months room temperature<br>(c) crease<br>(d) heat 1 hour 130°<br>(e) steam 90 minutes | 60 |

All samples showed less than 2% area shrinkage. Untreated fabric samples subjected to the above sequences showed more than 6% area shrinkage and the creases were no longer present.

We claim:

1. A process for the treatment of fibrous materials which comprises the steps of treating the fibrous materials with a composition containing:

a component A selected from the class consisting of polyorganosiloxanes of the general formula $$R_nSiO_{\left(\frac{4-n}{2}\right)}$$

in which $n$ has an average value in the range 1.8 to 2.2, and R represents organic radicals attached to the silicon atoms by carbon-silicon bonds; wherein between 1.0 and 50% of the radicals R consist of one or more organic radicals containing an epoxide group and selected from the class consisting of: 1,2-epoxyethyl; 3,4-epoxycyclohexyl; 6-methyl-3,4-epoxycyclohexyl; 3,4-epoxycyclohexyl-1-ethyl; 9,10-epoxystearyl; 3-(2,3-epoxypropoxyl)propyl; p-(2,3-epoxybutyl)-phenyl; and 3-(3,4-epoxybutyl)cyclohexyl, and the remainder of the radicals R consist of one or more organic radicals selected from the class consisting of alkyl and aryl radicals; selected from the group consisting of:

(a) Diamines of the type $NH_2(CH_2)_nNH_2$, where $n$ is 10 or greater;

(b) Amines of the type $YNH(CH_2)_nNH_2$, where $n$ is 2 or greater; and Y is an alkyl radical containing more than 10 carbons;

(c) Linear or branched polymers of ethylene oxides or propylene oxides with terminal 2-aminoethyl or 2-aminopropyl either groups or mixtures of said polymers;

(d) Di- and higher amines prepared by the reduction of the nitriles of the polymers of unsaturated fatty acids;

(e) Products from the reaction of (d) with acrylonitrile which have been subsequently hydrogenated;

or an amine component C wherein C is an amine of the type $R'''NH_2$ or $R_2'''NH$ wherein R''' is an alkyl or alkenyl group containing twelve or more carbon atoms;

or a mixture of components B an C;

and allowing the components A and B to react chemically.

2. A process as claimed in claim 1, wherein the component A is one or more linear polydimethylsiloxanes with viscosity at 25° C in the range 100–50,000 cst. and in which 5–50% of the methyl groups are replaced by one of the radicals

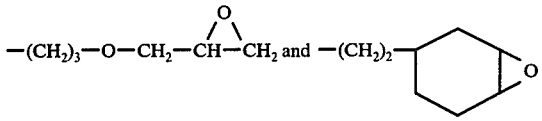

3. A process as claimed in claim 1, wherein the component B is present in a latent form which can be converted into component B by chemical reaction before, during, or after the application to the fibrous materials.

4. A process as claimed in claim 1, wherein the composition contains one or more epoxides, in addition to components A and B.

5. A process as claimed in claim 1, wherein the fibrous material is treated in the form of loose fibre, yarn or fabric with from 0.1 to 50% by weight of the composition of A and B, in which the ratio of A and B components by weight is in the range 1:100 to 100:1.

6. A process as claimed in claim 5, wherein the fibrous material is treated with from 1 to 10% by weight of the composition.

7. A process as claimed in claim 5, wherein the material is treated with a solution of the composition in an organic solvent.

8. A process as claimed in claim 5, wherein the material is treated with an emulsion or dispersion of the composition of with an emulsion or dispersion in water of a solution of the composition in a water-miscible solvent.

9. A process as claimed in claim 5, wherein the material is treated with an emulsion of component A in which the aqueous phase contains dissolved component B as the free polyamine or in the form of a salt with an organic or inorganic acid.

10. A process as claimed in claim 5, wherein after the treatment, the material is dried to remove water and solvent if present.

11. A process as claimed in claim 1, wherein the fibrous material is wool.

* * * * *

UNITED STATES PATENT AND TRADEMARK OFFICE

CERTIFICATE OF CORRECTION

PATENT NO. : 4,101,272

DATED : July 18, 1978

INVENTOR(S) : /Geoffrey Bruce GUISE and Francis William JONES

It is certified that error appears in the above-identified patent and that said Letters Patent are hereby corrected as shown below:

In the claims:

Claim 1, column 9, line 2, after "aryl radicals;", insert new paragraph --and a polyamine component B-- before "selected from the group consisting of:".

Claim 8, column 10, line 28, after "composition" delete "of" and substitute therefor --or--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*